United States Patent [19]

Asselbergs

[11] Patent Number: 4,809,593

[45] Date of Patent: Mar. 7, 1989

[54] PORTABLE FAN DEVICE FOR FORCED AIR HEATING

[75] Inventor: Christophe K. J. Asselbergs, Bragg Creek, Canada

[73] Assignee: Suncourt Holdings Inc., Alberta, Canada

[21] Appl. No.: 940,664

[22] Filed: Dec. 11, 1986

[30] Foreign Application Priority Data

Jul. 9, 1986 [CA] Canada ..... 513384

[51] Int. Cl.[4] ..... F24F 7/06

[52] U.S. Cl. ..... 98/103; 236/49

[58] Field of Search ..... 98/39.1, 40.24, 40.27, 98/101, 103, 108; 236/49 D, 49 R; 417/360

[56] References Cited

U.S. PATENT DOCUMENTS

| | | | |
|---|---|---|---|
| 1,426,900 | 8/1922 | Neal | 98/103 |
| 1,645,140 | 10/1927 | Herbruck | 98/101 |
| 1,743,994 | 1/1930 | Waterbury | 98/108 |
| 1,843,786 | 2/1932 | Robinson | 98/103 |
| 1,875,683 | 9/1932 | Waterbury | 98/108 |
| 1,886,841 | 1/1932 | Searles | 98/101 |
| 2,043,934 | 6/1936 | Spear | 98/101 |
| 2,646,744 | 7/1953 | Andrews | 98/108 |
| 2,661,895 | 12/1953 | Frick | 98/94.1 X |
| 2,972,941 | 2/1961 | Bennett | 98/101 |
| 3,002,676 | 10/1961 | Papsdorf | 417/360 |
| 3,035,421 | 5/1962 | Halbeisen | 98/40.24 X |
| 3,099,201 | 7/1963 | Gottlieb | 98/101 |
| 3,985,295 | 10/1976 | Monninger | 236/38 |
| 4,120,615 | 10/1978 | Keem et al. | 417/360 |
| 4,576,331 | 3/1986 | Harwell | 98/103 X |

FOREIGN PATENT DOCUMENTS

| | | | |
|---|---|---|---|
| 471645 | of 0000 | Canada . | |
| 857627 | 12/1970 | Canada . | |
| 947732 | 5/1974 | Canada . | |
| 1143210 | 3/1983 | Canada . | |
| 1146398 | 5/1983 | Canada . | |
| 1181379 | 1/1985 | Canada . | |
| 1515197 | 6/1978 | United Kingdom | 417/360 |

*Primary Examiner*—Harold Joyce

*Attorney, Agent, or Firm*—Beveridge, DeGrandi & Weilacher

[57] ABSTRACT

A readily portable fan device which is usable both as a cooling fan for circulating ambient air and as a device for increasing the flow of air through a register, comprises a housing containing both a fan impeller and an electric motor for driving the impeller, the housing having a skirt surrounding a bottom air inlet and capable of at least partially sealing a space around such register, the fan directing air upwardly when resting on the skirt. The device has another floor engaging surface perpendicular to the plane of the skirt on which the device may rest with its air inlet open to the ambient air.

2 Claims, 3 Drawing Sheets

PORTABLE FAN DEVICE FOR FORCED AIR HEATING

The present invention relates to a fan for use in domestic hot air heating and for cooling.

It has previously been proposed to increase the efficiency of forced air heating systems by use of a fan placed against a wall or floor register to boost the flow of air through the register. A thermostatic control may be provided so that the fan only operates when hot air is being delivered to the register. Most of the prior art proposals require more or less complicated installation and wiring of the device, and do not allow the device to be used as a fan for circulating ambient air within a room.

The present invention provides a readily portable fan device usable either as a cooling fan for circulating ambient air within a room, or as a device for increasing the flow of air through a register, normally a floor register, which may be cool air or heated air depending on requirements. The device requires no special installation.

In accordance with the invention, a fan device comprises a housing containing both a fan impeller and an electric motor for driving the impeller, the housing having a skirt surrounding a bottom air inlet and capable of at least partially sealing a space around the register. The fan is arranged to direct air generally upwardly through an outlet in the housing when the device is resting on the skirt. The device has a further floor engaging surface generally perpendicular to the plane of the skirt edges and on which the device may alternatively rest, with the air inlet open to the ambient air, when used as a cooling fan.

The further floor engaging surface may be provided by feet fixed to a rear side of the housing, the outlet being angled relative to the floor engaging surface so as to direct air at an upward angle when the device is resting on the feet.

The invention will further be described with reference to the accompanying drawings showing a preferred embodiment, and in which.

The main parts of this fan device are made of plastics material and can easily be snapped together.

The device includes a housing 10, which may be vacuum formed or injection molded of plastics material, and is generally rectangular having vertical front and rear walls 10*a* and 10*b*, and trapezoidal end walls 10*c*. In the rear wall 10*b*, which is higher than front wall 10*a*, is a recessed hand hold 10*b*'. Around the base of the housing is a thickened skirt 10*d*, immediately above which is an internal rib 10*e* having an inwardly opening groove. This groove receives locking tabs spaced around the periphery of air intake screen 12, which is also integrally molded of plastics material and which has a rectangular grid of openings. The skirt 10*b* is sized to fit around and form a substantial seal around a typical floor register used as an outlet for heated air in domestic forced air heating systems; typical external dimensions are 29.5 cm. by 14.5 cm.

The top of the housing 10 slopes upwardly from front to rear, and is provided with an outlet comprising two side-by-side circular openings which are defined by inner duct portions 10*f*. As will be evident particularly from FIG. 4 these duct portions almost meet at the center. The duct portions have parallel axes which are perpendicular to the plane of the housing top.

Figure 4:
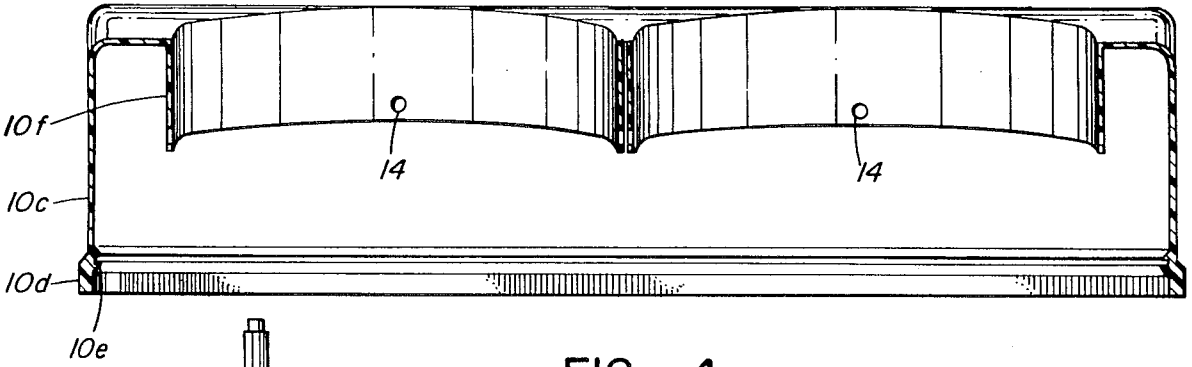
FIG. 4 is a sectional elevation taken on lines 4—4 of FIG. 1.
Figure 5:
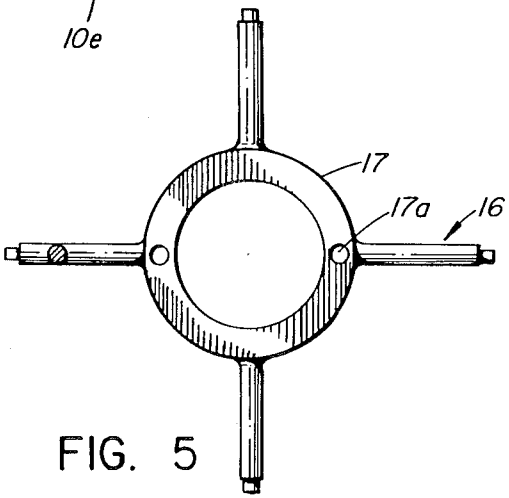
FIG. 5 is a view of a spider member used to mount the fan motors.

The lower end of each inner duct has a series of four equally spaced apertures 14 (as shown in FIG. 4), which receive the end spigots of a spider bracket 16 shown in FIG. 5. The central ring 17 of this spider bracket has holes 17a which receive bolts holding an electric motor 18 just below the spider bracket. Each motor has an upwardly projecting shaft to which is secured an axial flow impeller 20 having four blades and having a tip-to-tip diameter just slightly less than the inner diameter of duct portion 10*f*. The mounting arrangement is such as to hold the motor and impeller co-axial with the respective inner duct. The motor is connected, by cables not shown, in circuit with a thermostat 22 mounted inside the lower rear of the housing, and also connected in series with a control switch 23 and indicator light (not shown). The thermostat 22 may be a snap-disc, bi-metallic, solid state device, such devices being readily available. The circuit for the motor may also include a timer and/or means for varying the speed of the motor.

Figure 1:
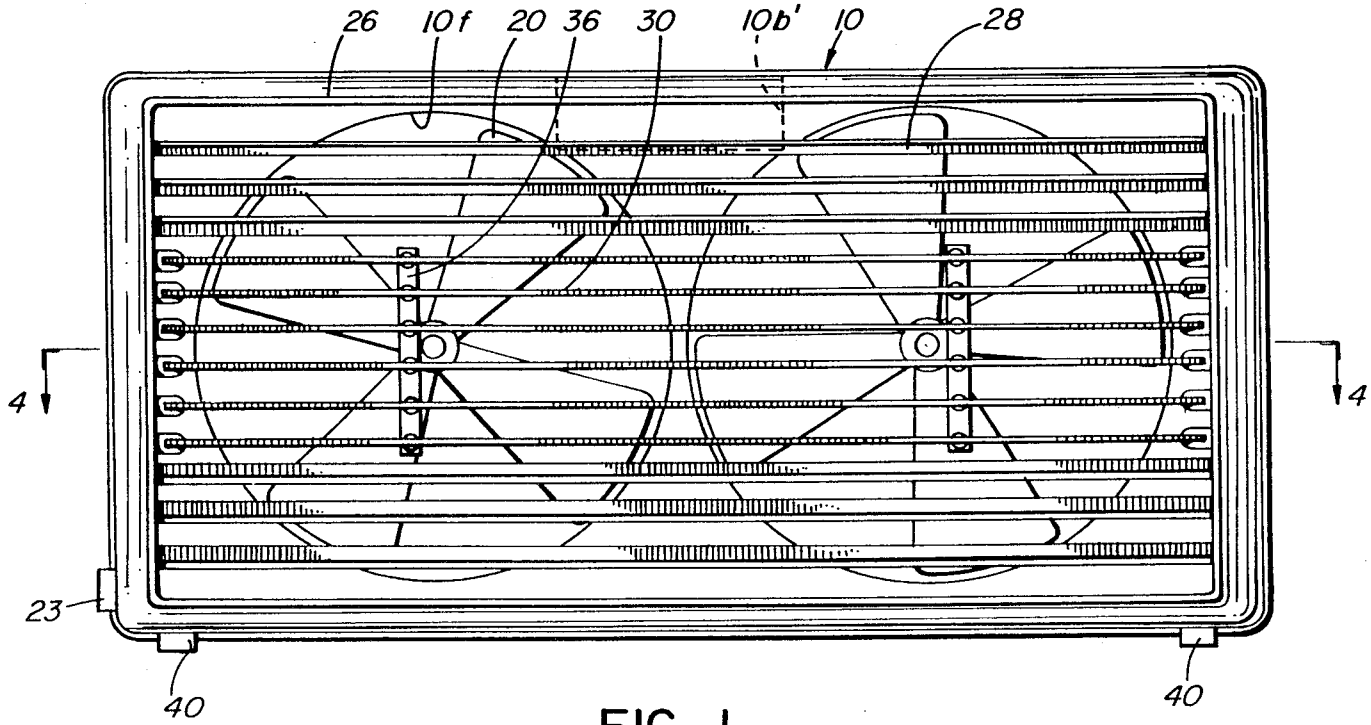
FIG. 1 is a plan view of the fan device.
Figure 3:
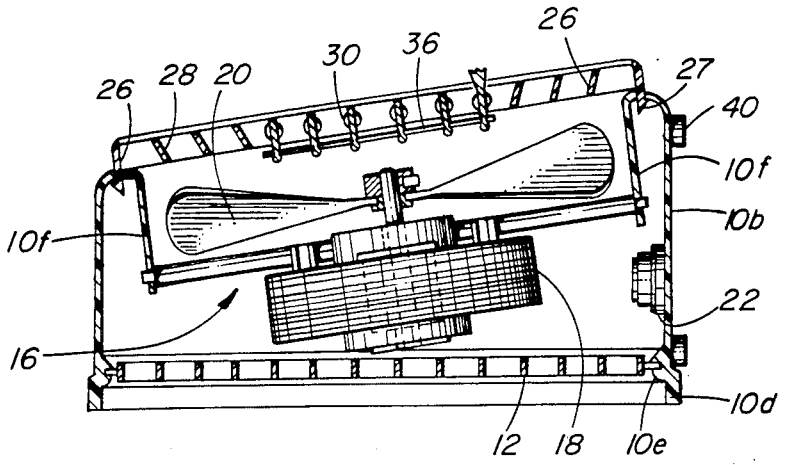
FIG. 3 is a cross-section taken on lines 3—3 of FIG. 1.
Figure 2:
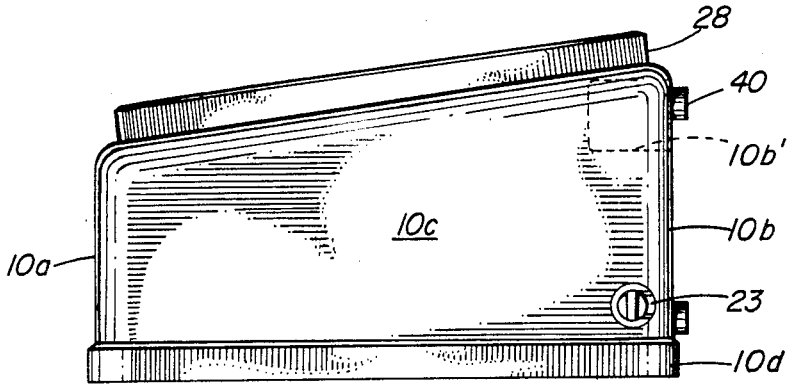
FIG. 2 is an end elevation of the device.
Figure 6:
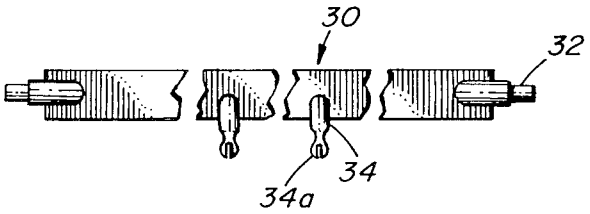
FIG. 6 is a view of an adjustable louver slat.

The air outlet above the impellers is provided with an exhaust louver structure including an integral molding having a rectangular frame 26 with locking tabs 27 inserted into apertures in the top of the housing outside the inner duct portions 10*f*, and structure which includes angled longitudinal louver slats 28. The slats 28 at the front of the device are angled to direct the air from impeller 20 forwards, while those at the back are angled to direct the air rearwards. Between these two sets of slats there is a set of six adjustable louver slats, a typical adjustable slat being shown in FIG. 6. Each of these slats has opposite end spigots 32 which are rotatable in apertures at opposite ends of the rectangular frame of the exhaust louver. Each slat has two lateral arms 34, each terminating in a ball member 34*a*, and these ball members are a snap fit onto tie-rods 36 which are seen in FIG. 1 and by which the slats are rotated together by finger tab 30*a*.

The rear wall 10*b* has a series of four adhesively mounted feet 40 on which the device may rest when being used as a personal fan.

When being used to supply additional heat from a forced air domestic heating system, the device is placed with its skirt surrounding a floor register, and the thermostat 22 is set at say 35° C., and the control switch is set so that the fan is activated automatically at this temperature. Thus, when the thermostat senses that heat is being supplied to the register the fan becomes operative. The fan not only increases the flow of air through the register, but since the air if flowing faster through the duct system it enters the room at a higher temperature. The device also continues to draw heat from the furnace heat exchanger for a few minutes after the furnace fan has shut down, thus increasing the efficiency of the furnace. If the device has a timer, this can be arranged to supply extra heat only during certain hours.

The device can also be used to increase the cooling effect of a central air conditioning system. In this case, the thermostat is adjusted to close when this senses cooled air being delivered through the register.

Additionally, the device can be used for cooling even where no air conditioning system is used. Firstly, with the device placed over a register, the fan can be operated continuously or intermittently to draw cool basement air through the register and into the room. Alternatively, the device can be used as a personal fan, by being placed to rest on its feet 40 so that the air inlet of the fan is opened to the ambient air. The device then operates as an ordinary personal fan, and for example may be placed on a counter top; it will be evident that in this situation the air flow will be directed partially upwards from such surface.

When resting on feet 40, the device may also be placed close to a wall register to boost the floor of warm or cool air from such register.

I claim:

1. A readily portable fan device usable both as a cooling fan for circulating ambient air and as a device for increasing the flow of air through a register, comprising a housing containing both a fan impeller and an electric motor for driving the impeller, said housing being generally rectangular and having a front wall, a back wall, two end walls and a top outlet, the lower edges of which walls terminate in a rectangular skirt surrounding an air inlet and having floor engaging edges capable of substantially sealing a space around said register, the impeller being arranged to direct air generally upwardly through said outlet when the device is resting on said skirt; wherein said front wall is lower than said back wall and the end walls are trapezoidal, said outlet being inclined to the plane of the skirt edges so as to direct air away from a plane occupied by said back wall, the device having further floor engaging surface means located on said back wall and occupying a plane generally perpendicular to the plane of said skirt edges and on which surface means the device may alternatively rest, with said air inlet open to the ambient air, when used as a cooling fan with air being directed partially upwardly from the plane of said floor engaging surface means; wherein said housing is molded from plastics material and includes at least one inner duct portion, and wherein said fan is an axial flow mounted on the projecting shaft of said motor and wherein said motor is held by a spider member having arms which are a snap fit into apertures in said duct portions.

2. A device according to claim 1, wherein two of said inner duct portions are provided, each accommodating an axial flow fan held by a spider member having arms which are a snap fit in said duct portions.

* * * * *